United States Patent [19]

Merkel

[11] Patent Number: 4,808,502

[45] Date of Patent: Feb. 28, 1989

[54] PHOTOGRAPHIC RECORDING MATERIAL COMPRISING A MAGENTA DYE IMAGE FORMING COUPLER COMPOUND

[75] Inventor: Paul B. Merkel, Rochester, N.Y.

[73] Assignee: Eastman Kodak Company, Rochester, N.Y.

[21] Appl. No.: 223,586

[22] Filed: Jul. 25, 1988

Related U.S. Application Data

[63] Continuation-in-part of Ser. No. 99,171, Sep. 21, 1987.

[51] Int. Cl.[4] ..... G03C 7/38; G03C 7/32

[52] U.S. Cl. ..... 430/17; 430/359; 430/543; 430/546; 430/554; 430/555; 430/558

[58] Field of Search ..... 430/17, 546, 551, 558, 430/555, 554, 543, 359, 377

[56] References Cited

U.S. PATENT DOCUMENTS 3,676,137 7/1972 Mizuki et al. ..... 430/546
4,448,878 5/1984 Yamamuro et al. ..... 430/551

FOREIGN PATENT DOCUMENTS 0102234 6/1984 Japan .
0204041 11/1984 Japan .

*Primary Examiner*—Richard L. Schilling
*Attorney, Agent, or Firm*—Thomas F. Kirchoff

[57] ABSTRACT

This invention relates to a color photographic silver halide recording material containing a dye image-forming coupler compound and a compound which is capable of altering the spectral absorption properties of a dye formed by reaction of the coupler compound with oxidized developing agent.

20 Claims, No Drawings

PHOTOGRAPHIC RECORDING MATERIAL COMPRISING A MAGENTA DYE IMAGE FORMING COUPLER COMPOUND

This is a continuation-in-part of U.S. application Ser. No. 099,171, filed Sept. 21, 1987.

This invention relates to a color photographic silver halide recording material. In particular, the invention relates to an improved photographic recording material containing a magenta dye image-forming coupler compound.

Color photographic recording materials generally contain silver halide emulsion layers sensitized to each of the blue, green and red regions of the visible spectrum, with each layer having associated therewith a color-forming compound which, respectively, yields a yellow, magneta or cyan dye. The quality of the resulting color image is primarily based on the dye hues obtained from the respective color-forming compounds.

Magenta dye image-forming couplers are frequently employed to provide desired magenta dye images. A problem encountered with such couplers is that the spectral absorption characteristics of dyes obtained therefrom may not have the particular absorption maximum and distribution that are desired. Frequently, a dye which is obtained may have an absorption maximum as little as several nanometers removed from the optimum desired value, and therefore will not have the desired hue, notwithstanding this slight difference in absorption characteristics. Conversely, a resulting dye may have an absorption maximum which is considerably shorter than a desired value.

Attempts to alter absorption characteristics of dyes, including those obtained from magenta dye image-forming coupler compounds, are usually focused on alterations of the structures of coupler compounds. This approach, while enjoying some measure of success, is time consuming and involves the expense of highly focused research programs. Success with such research is not predictable so that improvements in final hue values have been elusive even after concentrated research efforts.

Some coupler solvents are known to cause shifts in absorption values of dyes. For example, U.S. Pat. No. 3,676,137 describes use of a phosphate ester of a high boiling coupler solvent to shift absorption of a cyan dye to a shorter wavelength in order to reduce excessive red wavelength absorption. Alternatively, Japanese Patent Publication No. 59(1984)-102234 describes the use of high boiling phenolic compounds to shift the spectral absorption of 2,5-diacylaminophenol cyan dye-forming coupler compounds to longer wavelengths. However, as is shown below by comparative data, a phenolic compound of this publication does not provide a sufficient level of hue shifting as compared with that obtained with the present invention.

Japanese Patent Publication No. 59(1984)-204041 describes use of urea compounds with cyan dye image-forming couplers to improve light fastness, to reduce unwanted green absorption and to reduce loss of density caused by bleach operations in dyes obtained from such couplers. This publication also suggests addition of other compounds that form dyes by oxidative coupling with primary amine color developing agents, such as magenta and yellow coupler compounds. However, there is no teaching or suggestion in this publication that particular urea compounds can be used to alter absorption characteristics of dyes derived from magenta dye forming coupler compounds.

U.S. Pat. No. 4,448,878 describes use of urea compounds in photographic materials which may contain dye-forming coupler compounds to overcome storage instability. The urea compounds comprise a 5-mercaptotetrazole substituted phenyl group on a nitrogen atom of the urea nucleus. However, there is no teaching or suggestion that the urea compounds can be employed to alter absorption characteristics of dyes derived from dye forming coupler compounds.

Accordingly, the object of the present invention is to provide a color photographic silver halide recording material having the capability of imparting slight as well as relatively large alterations in absorption properties of a magenta dye to obtain a spectral absorption value different from the inherent absorption characteristics of the dye.

A color photographic recording material according to this invention comprises a support having thereon a light-sensitive silver halide emulsion layer, a magenta dye image-forming coupler capable of forming a dye by reaction with oxidized color developing agent and, associated with the coupler, a urea compound which is capable of altering the spectral absorption of the magenta dye formed from the coupler, said urea compound having the structural formula:

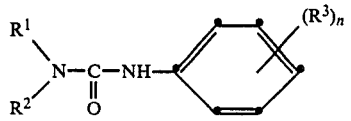

wherein;

$R^1$ is an alkyl or an aryl group;

$R^2$ is hydrogen or an alkyl group;

$R^3$ is an alkyl or an alkoxy group or an electron-withdrawing group with the proviso that $R^3$ is not a 5-mercaptotetrazole group; and n is from 0 to 3.

This invention also relates to a color photographic record comprising a magenta dye formed by a coupling reaction between a magenta dye image-forming coupler and oxidized silver halide developing agent, which recording material comprises, in association with the dye, a urea compound having the structural formula:

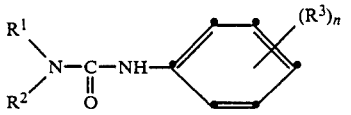

wherein;

$R^1$ is an alkyl or an aryl group;

$R^2$ is hydrogen or an alkyl group;

$R^3$ is an alkyl or an alkoxy group or an electron-withdrawing group with the proviso that $R^3$ is not a 5-mercaptotetrazole group; and n is from 0 to 3.

$R^1$ can be represented by alkyl groups having from 1 to about 20 carbon atoms, preferably from 1 to about 12 carbon atoms, which groups can be straight or branched chain and optionally can be substituted. Aryl groups which can be represented by $R^1$ have from about 6 to about 12 carbon atoms, which groups are optionally substituted.

Useful $R^2$ groups are hydrogen or alkyl as defined for $R^1$.

The most preferred urea compounds are those where $R^1$ is an alkyl group having from about 4 to about 10 carbon atoms and where $R^2$ is hydrogen.

$R^3$ substituents can be alkyl or alkoxy groups having from 1 to about 20 carbon atoms, preferably from 1 to about 12 carbon atoms, which groups can be straight or branched chain and which can be substituted.

Substituents which can be present on the $R^1$ and $R^2$ groups include halogen atoms, such as chlorine and bromine, and alkoxy or carboalkoxy groups wherein the total number of carbon atoms in such groups is from 2 to about 12. When $R^1$ is aryl the substituents can also be alkyl, preferably alkyl having from 1 to about 12 carbon atoms.

Electron-withdrawing groups represented by $R^3$ include —CN, $—NO_2$, a halogen atom, $$-\underset{\underset{O}{\|}}{C}R^4$$

and $—SO_2R^4$, where $R^4$ is an alkyl or an alkoxy group having from 1 to about 20 carbon atoms or an aryl or an aryloxy group having from about 6 to about 12 carbon atoms.

Chlorine is a preferred halogen substituent on the phenyl group inasmuch as it provides good stability properties and is least expensive to manufacture.

The described urea compounds can be easily synthesized in quantitative yield by adding amines to isocyanates according to the procedures known in the art. Two or more urea compounds may be used in combination to alter the spectral absorption properties of magenta dyes as described herein.

There are no particular restrictions on the quantity of a urea compound which can be employed with a magenta dye image-forming compound either alone or in combination with known coupler solvents. Generally, it is desirable that the quantity of urea compound, with respect to each part by weight of the magenta coupler, be from about 0.05 to about 10 parts, preferably from about 0.2 to about 3 parts by weight of the coupler compound. As the amount of urea compound increases, relative to the amount of magenta coupler compound employed, there is usually a detectable increase in the extent of hue shift in the magenta dye. However, the particular choice of magenta coupler, of urea compound or the presence of one or more coupler solvents, all tend to influence the type and the extent of spectral absorption change in the resulting magenta dye.

When the magenta coupler compound is added to a silver halide emulsion, conventional procedures may be employed. For example, the coupler can first be dissolved in one or more known coupler solvents, such as di-n-butyl phthalate (DBP), and then be mixed with a urea compound as described herein. If desired, the magenta coupler compound can be mixed with a urea compound where these compounds are sufficiently compatible so that known coupler solvents may not be needed. The resulting mixture or solution is then dispersed in aqueous gelatin, preferably containing a surfactant, and the dispersion is added to a silver halide emulsion which can then be coated by known techniques.

Specific urea compounds which are useful for shifting the absorption values of magenta dyes obtained from the reaction of magenta dye-forming couplers with oxidized color developing agent include the following:

1.
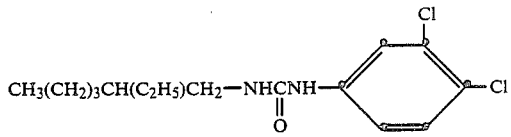

2.
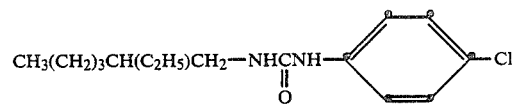

3.
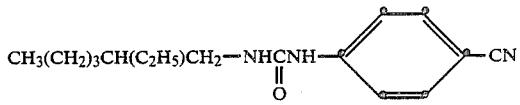

4.
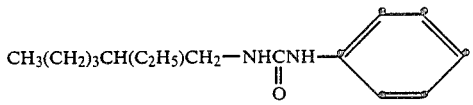

5.
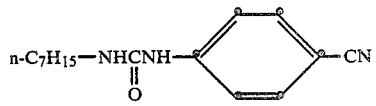

6.
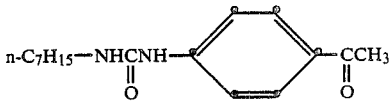

7.
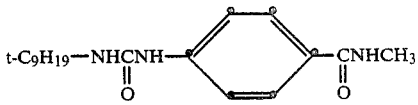

8.
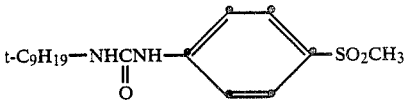

9.
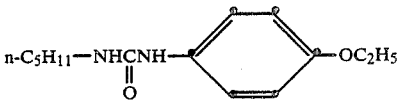

10.
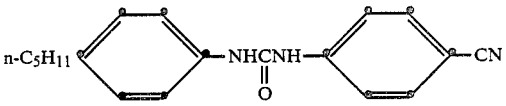

11.
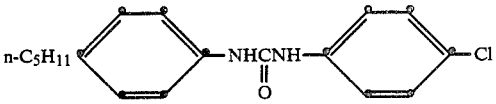

12.
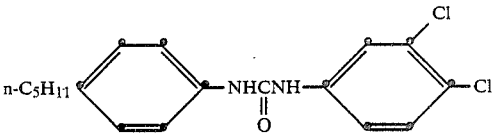

Couplers which form magenta dyes upon reaction with oxidized color developing agents are described in such representative patents and publications as: U.S. Pat. Nos. 1,969,479; 2,311,082; 2,343,703; 2,369,489; 2,600,788; 2,908,573; 3,061,432; 3,062,653; 3,152,896; 3,519,429; 3,725,067; 4,443,536; European Patent Publication No. 170164; European Patent Publication Nos. 177,765; and copending U.S. patent applications Ser. No. 23,517 of S. Normandin et al, filed Mar. 9, 1987; Ser. No. 23,518 of R. Romanet et al, filed Mar. 9, 1987; Ser. No. 23,519 of A. Bowne et al, filed Mar. 9, 1987 and Ser. No. 23,520 of A. Bowne et al, filed Mar. 9, 1987, the disclosures of which are incorporated herein by reference.

Preferred magenta couplers include pyrazolones having the structural formulae:

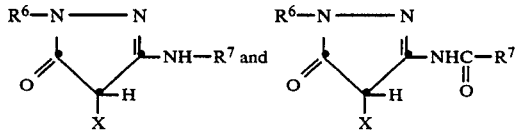

pyrazolotriazoles having the structural formulae:

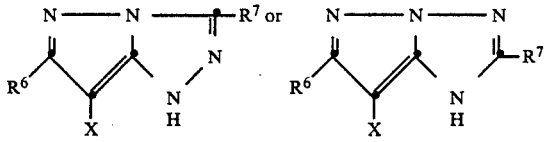

pyrazolobenzimidazoles having the structural formulae:

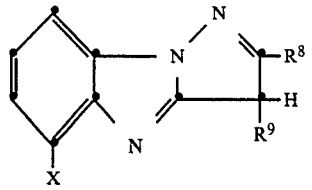

and

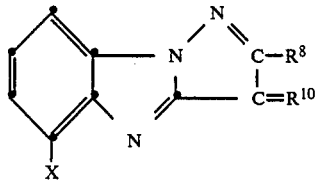

and indazoles having the structural formula:

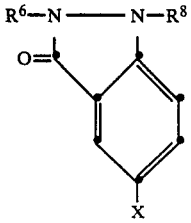

wherein $R^6$ is halogen (e.g., chloro, fluoro), alkyl or alkoxy having from 1 to 4 carbon atoms, phenyl or substituted phenyl (e.g., 2,4,6-trihalophenyl);

$R^7$ is a ballast group;

$R^8$ is hydrogen or a monovalent organic radical, for example a saturated or unsaturated alkyl group having from 1 to about 20 carbon atoms (methyl, ethyl, propyl, butyl, decyl, dodecyl, heptadecyl, octadecyl); a cycloalkyl group (e.g. cyclohexyl); an aralkyl group (e.g. benzyl); an aryl group (e.g. phenyl, alkoxyphenyl in which the alkyl or alkoxy radical has from 1 to about 20 carbon atoms, nitrophenyl, aminophenyl, acylaminophenyl, alkylaminophenyl, naphthyl, diphenyl, diphenylether, diphenylthioether); a heterocyclic group (e.g. α-furyl, α-benzofuryl, γ-pyridyl); an amino, hydroxy or carboxylic acid group, it being possible for the hydrogen atoms of these groups to be substituted, for instance by a mono- or dialkylamino group in which the alkyl groups have from 1 to about 20 carbon atoms; a cycloalkylamino group; an amino group in which one hydrogen atom is replaced by a pyrazolo-[1,5-a]-benzimidazolyl radical which is bonded in 3-position to said nitrogen atom so that couplers result in which two pyrazolo-[1,5-a]-benzimidazolyl radicals are connected by an amino group, and in which the remaining hydrogen atom may be replaced by a substituent such as an alkyl-, aryl-, aralkyl- or acyl- radical; an acylamino group in which the acyl radical is derived from an aliphatic, aromatic or heterocyclic carboxylic acid; a carboxylic acid group which is esterified by means of an aliphatic, cycloaliphatic or aromatic alcohol or by an aromatic compound having a phenolic hydroxy group; or a carboxyamido group in which the amido group may be substituted for example by a saturated or unsaturated alkyl, aralkyl, aryl or heterocyclic group;

$R^9$ represents a hydrogen atom, a sulphonic acid or carboxylic acid group; a halogen atom (e.g. chlorine or bromine); or an azo radical $-N{=}NR^{14}$, wherein $R^{14}$ can be an aromatic or heterocyclic radical (phenyl, naphthyl, diphenyl, diphenylether, benzthiazolyl, pyridyl, quinolyl or pyrazolyl) which may be substituted such as by an alkyl group having from 1 to about 20 carbon atoms, hydroxy, alkoxy, halogen, amino, substituted amino, nitro, sulphonic acid or carboxylic acid groups;

$R^{10}$ represents a divalent radical such as

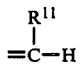

wherein $R^{11}$ can be alkyl, aralkyl, especially phenyl, phenyl substituted preferably in the p-position by a tertiary amino group such as a dialkylamino group in which at least one of the alkyl groups is substitued by carboxy, sulpho, hydroxy, alkoxy, carboxylalkyl, cyano or the divalent radical

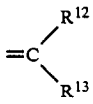

wherein $R^{12}$ and $R^{13}$ represent aliphatic, aromatic, araliphatic or heterocyclic radicals, and X represents hydrogen or a coupling off group.

Specific magenta dye forming coupler compounds which are useful in the practice of this invention include:

C-1
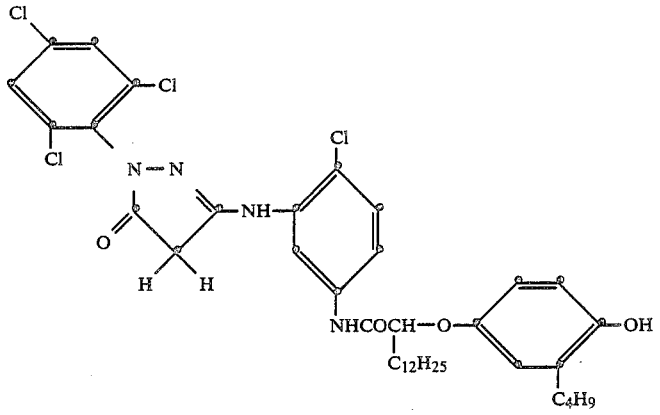
C-2
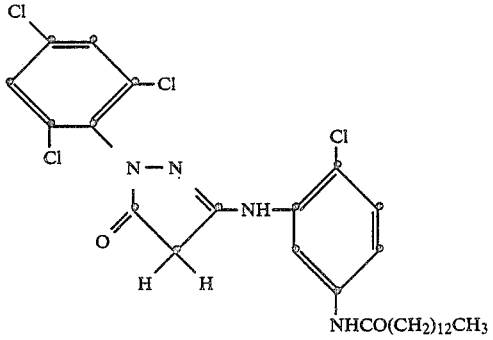
C-3
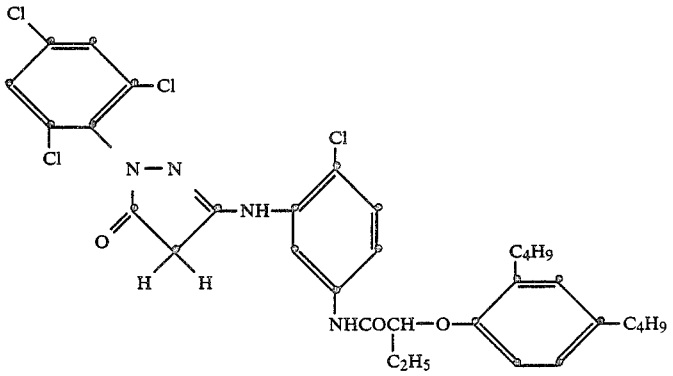
C-4
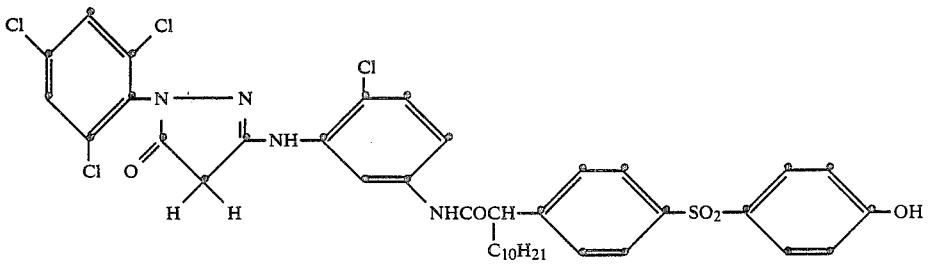

-continued
C-5
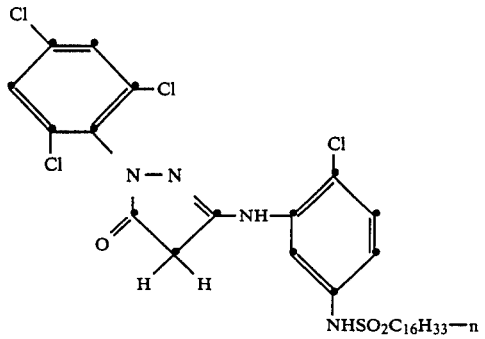
C-6
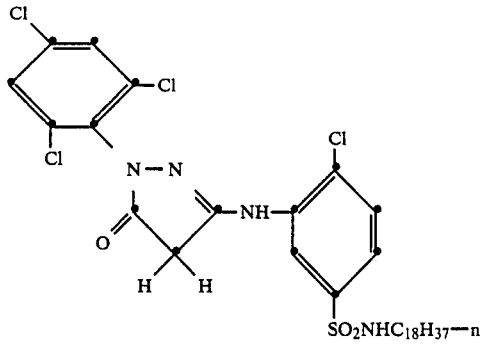
C-7
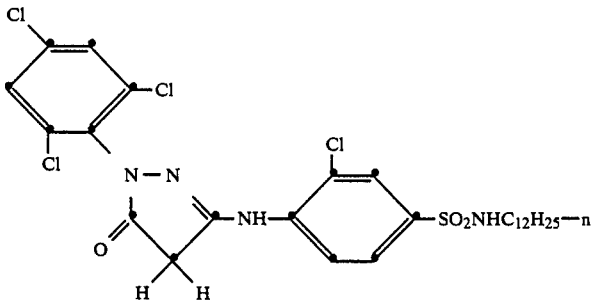
C-8
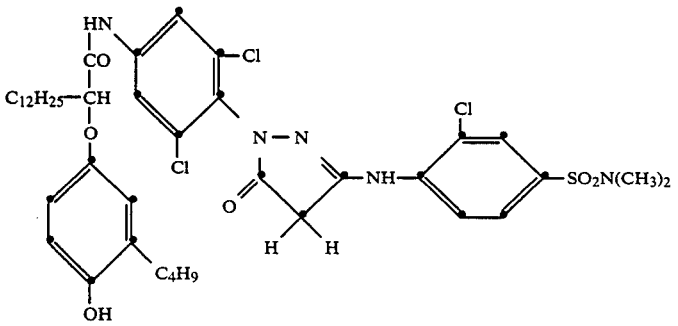

-continued
C-9
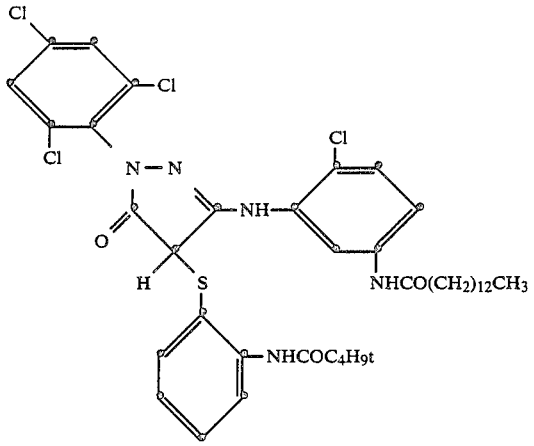
C-10
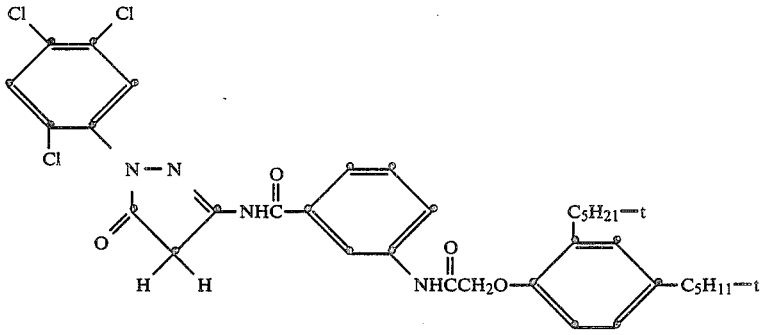
C-11
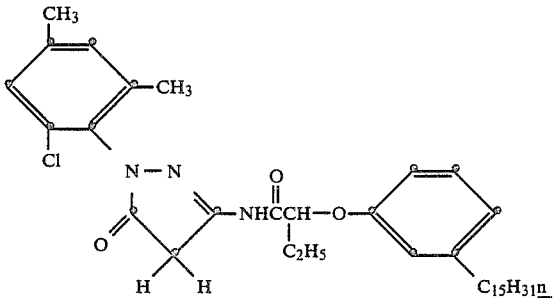
C-12
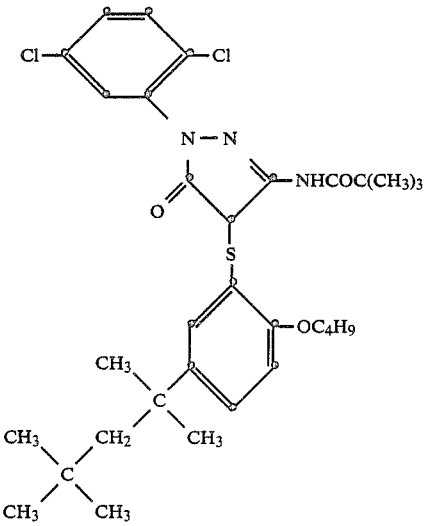

-continued
C-13
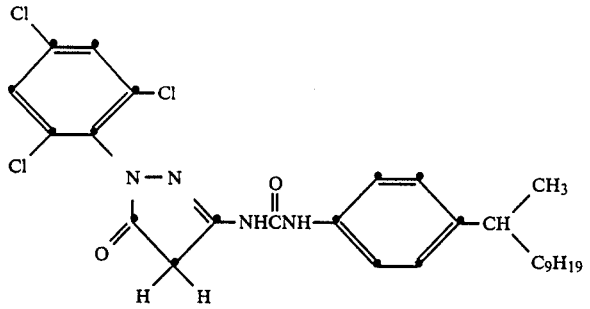
C-14
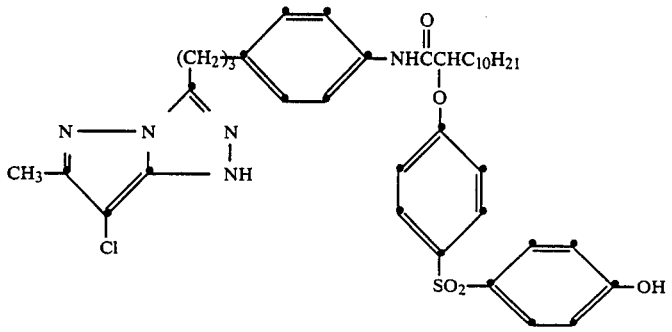
C-15
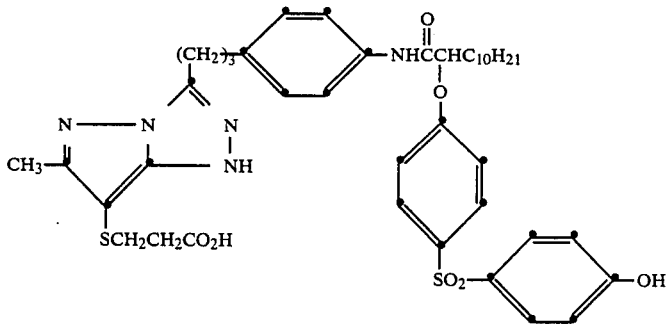
C-16
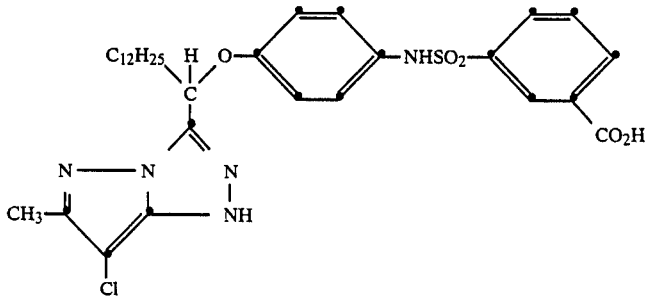
C-17
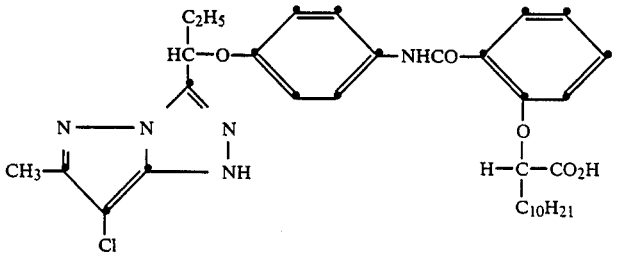

-continued
C-18
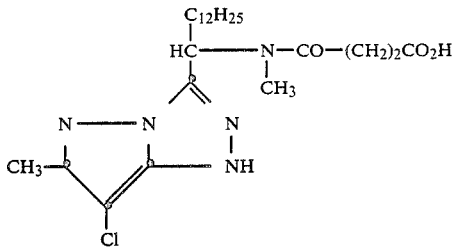
C-19
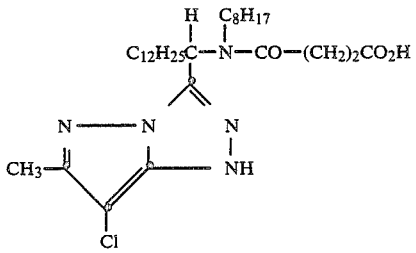
C-20
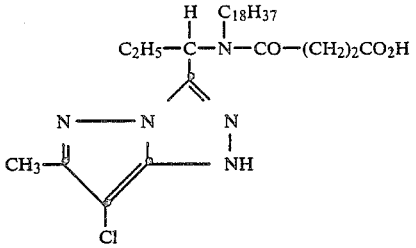
C-21
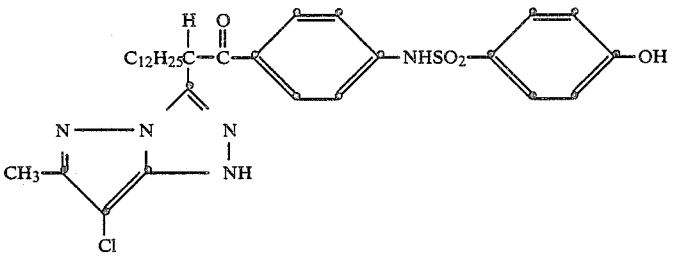
C-22
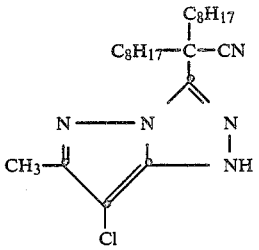
C-23
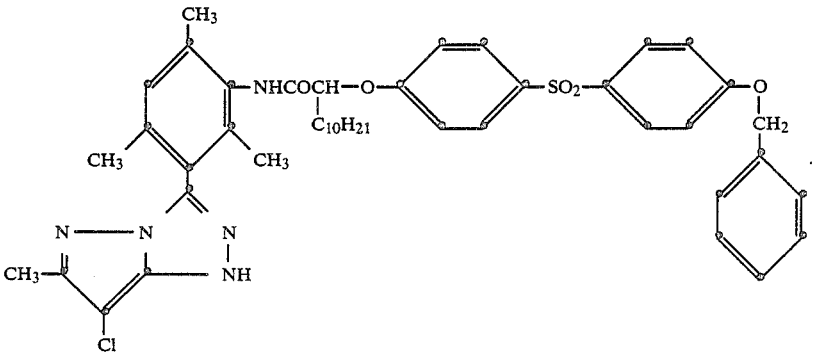

-continued
C-24
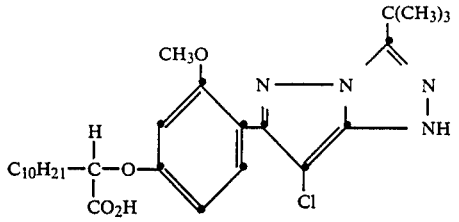
C-25
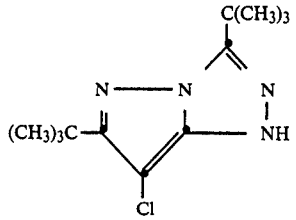
C-26
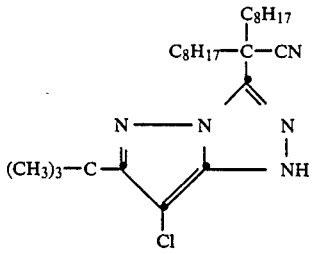
C-27
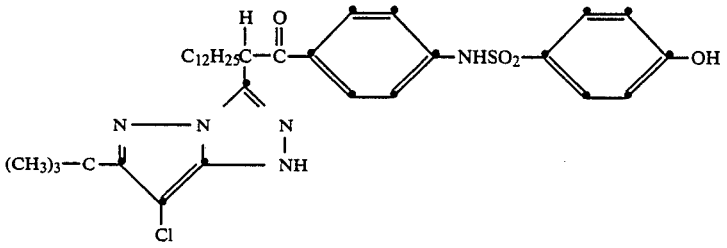
C-28
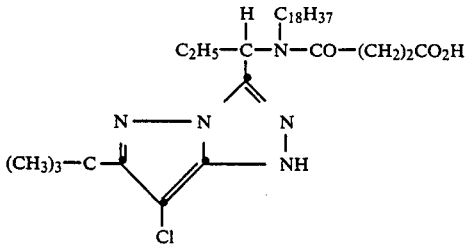
C-29
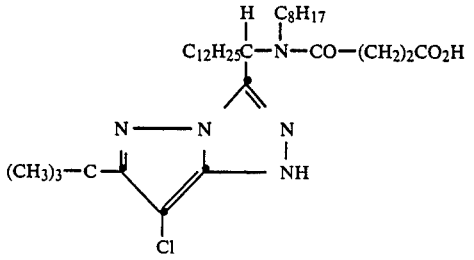

-continued
C-30
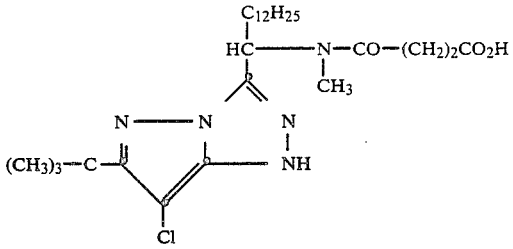
C-31
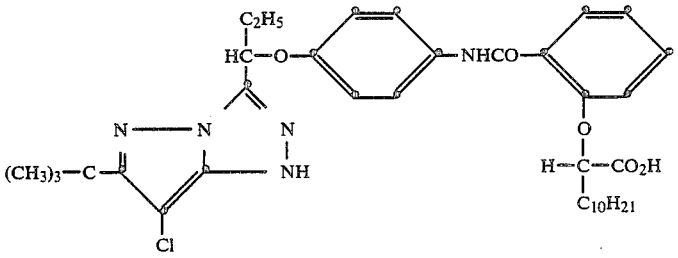
C-32
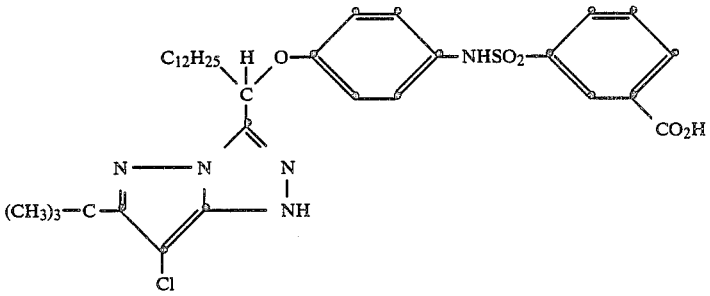
C-33
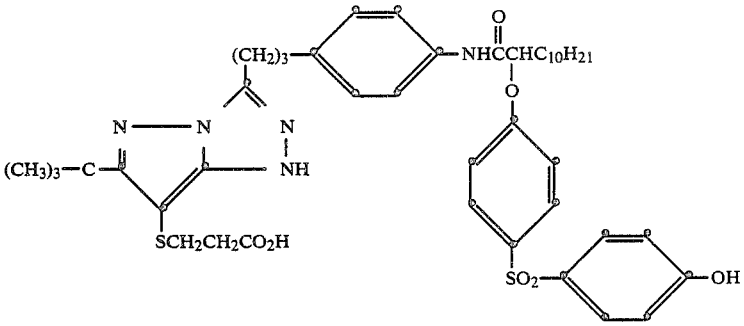
C-34
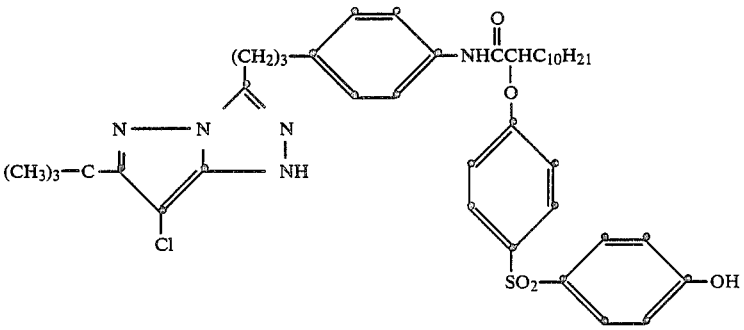

-continued
C-35
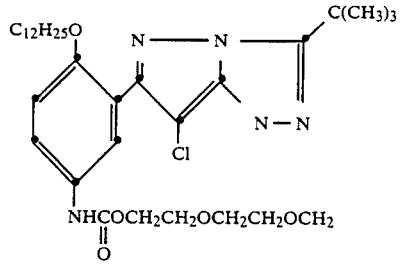
C-36
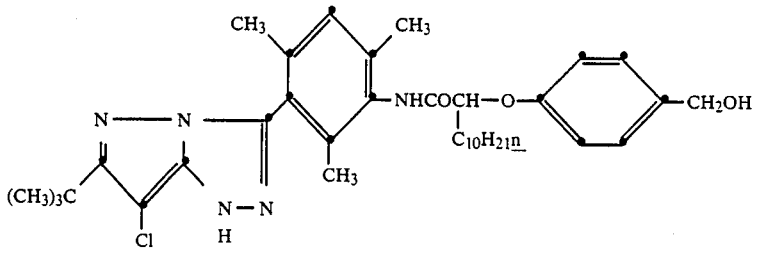
C-37
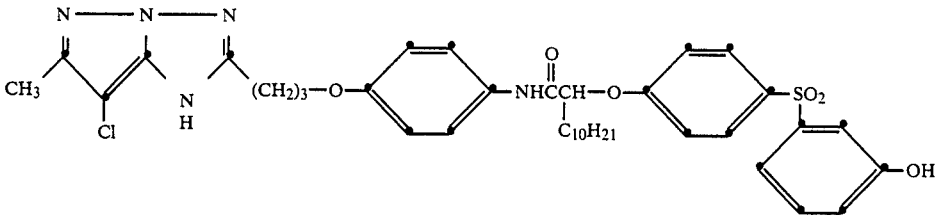
C-38
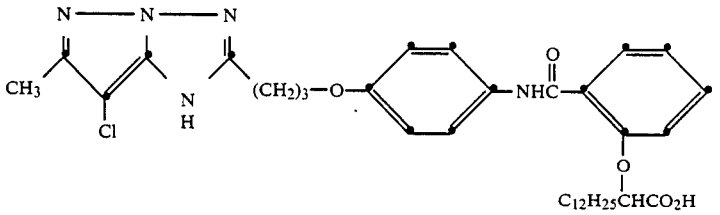
C-39
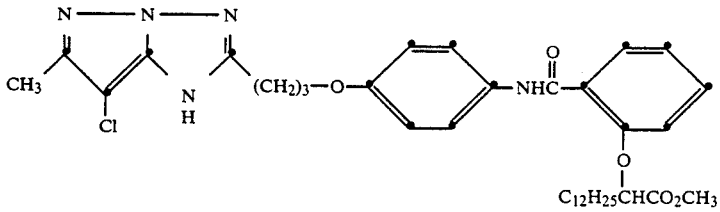
C-40
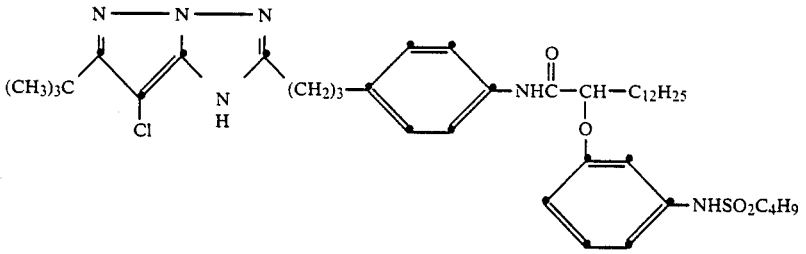

-continued

C-41

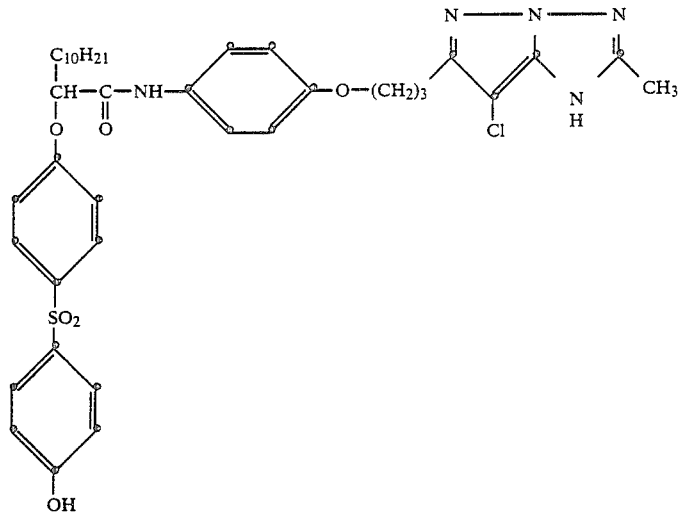

Photographic elements in which the photographic couplers of this invention are incorporated can be simple elements comprising a support and a single silver halide emulsion layer, or they can be multilayer, multicolor elements. The coupler compounds of this invention can be incorporated in the silver halide emulsion layer or in another layer, such as an adjacent layer, where they will come into reactive association with oxidized color developing agent which has developed silver halide in the emulsion layer. The silver halide emulsion layer can contain, or have associated therewith, other photographic coupler compounds, such as color forming couplers, colored masking couplers, etc. These other photographic coupler compounds can form dyes of the same or different color and hue as the photographic coupler compounds of this invention. Additionally, the silver halide emulsion layer can contain addenda conventionally contained in such layers.

A typical multilayer, multicolor photographic element according to this invention comprises a support having thereon a red-sensitive silver halide emulsion layer having associated therewith a cyan dye image-forming coupler compound, a green-sensitive silver halide emulsion layer having associated therewith a magenta dye image-forming coupler compound and a blue-sensitive silver halide emulsion layer having associated therewith a yellow dye image-forming coupler compound, wherein the magenta dye image-forming coupler compound has associated therewith a urea compound as described herein. Each silver halide emulsion layer can be composed of one or more layers and the layers can be arranged in different locations with respect to one another. Typical arrangements are described in U.S. Pat. Nos. 3,227,554; 3,620,747; 3,843,369; and 4,400,463 and in U.K. Pat. No. 923,045.

The light sensitive silver halide emulsions can include coarse, regular or fine grain silver halide crystals or mixtures thereof and can be comprised of such silver halides as silver chloride, silver bromide, silver bromoiodide, silver chlorobromide, silver chloroiodide, silver chlorobromoiodide and mixtures thereof. The emulsions can be negative-working or direct-positive emulsions. They can form latent images predominantly on the surface of the silver halide grains or predominantly on the interior of the silver halide grains. They can be chemically and spectrally sensitized. The emulsions typically will be gelatin emulsions although other hydrophilic colloids can be used in accordance with usual practice.

The support can be of any suitable material used with photographic elements. Typically, a flexible support is employed, such as a polymeric film or paper support. Such supports include cellulose nitrate, cellulose acetate, polyvinylacetal, polyethylene terephthalate, polycarbonate and resinous materials as well as glass, paper or metal. Paper supports can be acetylated or coated with baryta and/or an α-olefin polymer, particularly a polymer of an α-olefin containing 2 to 10 carbon atoms such as polyethylene, polypropylene or ethylene-butene copolymers.

Further details regarding silver halide emulsions and elements, and addenda incorporated therein can be found in *Research Disclosure,* December 1971, Item 9232, Paragraphs I through XVIII. *Research Disclosure* is published by Industrial Opportunities Ltd., Homewell, Havant, Hampshire, PO9 1EF, United Kingdom.

The term "in association" is intended to mean that materials can be in either the same or different layers, so long as the materials are accessible to one another.

The following examples further illustrate the invention. Unless otherwise indicated all parts, percents and ratios are by weight.

EXAMPLE 1

Single layer coatings containing silver bromoiodide emulsion (6.5 mole % I) comprising unsensitized polydisperse medium-large grains (0.91 gAg/m$^2$) were prepared on cellulose acetate-butyrate supports. Each layer also contained gelatin (3.8 g/m$^2$) and the magenta coupler C-4 (1.3 g/m$^2$) as described above. The coupler was dispersed in di-n-butyl phthalate (DBP) (1.3 g/m$^2$ when used alone) or in combination of DBP and a urea compound (each at 0.65 g/m$^2$) as described below in Table 1. Each coating was exposed imagewise through a graduated-density test object to provide a maximum density image and was processed at 33° C. employing the color developer solution described below, and then subjected to 1.5 minutes in the bleach-fix bath described below, washed and dried.

| Color Developer (pH 10.08) | |
|---|---|
| Triethanolamine | 11 mL |
| Benzyl alcohol | 14.2 mL |
| Lithium chloride | 2.1 g |
| Potassium bromide | 0.6 g |
| Hydroxylamine sulfate | 3.2 g |
| Potassium sulfite (45% solution) | 2.8 mL |
| 1-Hydroxyethylene-1,1-di phosphoric acid (60%) | 0.8 mL |
| 4-Amino-3-methyl-N—ethyl-N—β-methanesulfonamido)ethyl-aniline sulfate hydrate | 4.35 g |
| Potassium carbonate (anhydrous) | 28 g |
| Water to make | 1.0 liter |
| Bleach-Fix Bath (pH 6.8) | |
| Ammonium Thiosulfate | 104 g |
| Sodium hydrogen sulfite | 13 g |
| Ferric ammonium ethylene-diamine tetraacetic acid | 65.6 g |
| Ethylenediamine tetraacetic acid | 6.56 g |
| Ammonium hydroxide (28%) | 27.9 mL |
| Water to make | 1 liter |

Transmission density versus wavelength data were obtained to determine the λ-max of the dye in dispersants. The data show a desirable and noticeable shift in hue to longer wavelength with addition or urea compounds.

TABLE I

| Urea Compound | Weight Ratio Coupler:DBP:Urea | λ-max (nm) |
|---|---|---|
| none | 2:2:0 | 549 |
| 1 | 2:1:1 | 551 |
| 3 | 2:1:1 | 551 |

As can be seen from the data in Table I, hue shifts are highly subtle and vary only a few nanometers from the control. Such variations in wavelength shifts offer a high degree of manipulative control and provide an excellent, inexpensive means to obtain particularly desired hue values.

EXAMPLE 2

This example is similar to Example 1, except that pyrazolotriazole magenta coupler C-14 (1.3 g/m$^2$) as described above, was used:

Coatings were prepared, exposed, processed, and evaluated as in Example 1. The same color developing agent and DBP (di-n-butyl phthalate) coupler solvent were used. Resulting data are reported in the following Table:

TABLE II

| Urea Compound | Weight Ratio Coupler:DBP:Urea | λ-max (nm) |
|---|---|---|
| none | 2:2:0 | 552 |
| 1 | 2:1:1 | 556 |
| 3 | 2:1:1 | 556 |

EXAMPLE 3

In another evaluation, not involving coupling to form a dye within a silver halide emulsion photographic system, the hue shifting of preformed magenta dyes was examined. A dye, a urea compound as described in Table III and the coupler solvent DBP (di-n-butyl phthalate) were mixed, dispersed in a gelatin vehicle and then coated in a single layer.

Evaluations of transmission density vs wavelength data were obtained and are reported in Table III.

TABLE III

| Magenta Dye | Urea Compound | Weight Ratio Dye:DBP:Urea | λ-max (nm) |
|---|---|---|---|
| A | none | 1:3:0 | 532 |
| A | * | 1:2:1 | 533 |
| A | 1 | 1:2:1 | 536 |
| A | 1 | 1:0:3 | 545 |
| A | 2 | 1:2:1 | 537 |
| A | 10 | 1:2:1 | 538 |
| A | 4 | 1:2:1 | 536 |
| A | 4 | 1:0:3 | 540 |
| B | none | 1:3:0 | 533 |
| B | * | 1:2:1 | 535 |
| B | 1 | 1:2:1 | 553 |
| B | 1 | 1:0:3 | 560 |
| B | 2 | 1:2:1 | 555 |

*Instead of a urea compound this example utilized the high boiling, hue shifting compound p-dodecyl phenol as described in Japanese Patent Publication No. 59(1984)-102234

Dye structures:

A

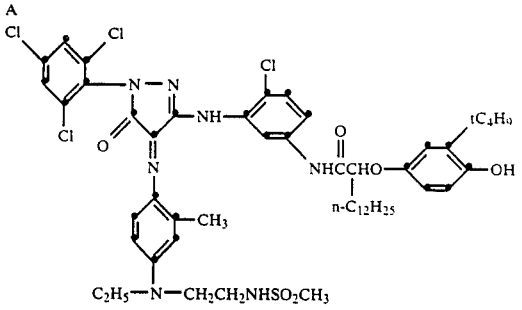

B

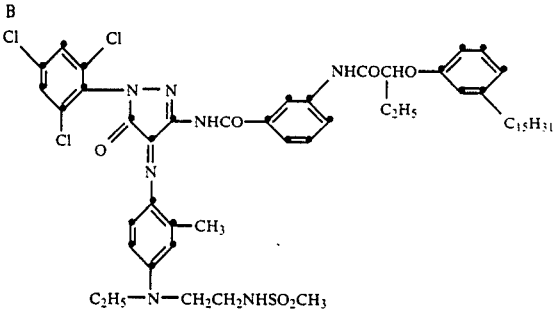

As can be seen from Table III the described urea compounds are capable of shifting magenta dye hue to longer wavelengths.

Inasmuch as the dyes utilized in Table III were all preformed and therefore avoided conventional aqueous processing, it can be appreciated that the concept of altering the spectral absorption of dyes is applicable to other than conventional photographic systems.

This invention has been described in detail with particular reference to preferred embodiments thereof, but it will be understood that variations and modifications can be effected within the spirit and scope of the invention.

What I claim is:

1. A color photographic recording material comprising a support having thereon a light-sensitive silver halide emulsion layer, a magenta dye image-forming coupler capable of forming a dye by reaction with oxidized color developing agent and, associated with the coupler, a urea compound which is capable of altering the spectral absorption of the magenta dye formed from the coupler, said urea compound having the structural formula:

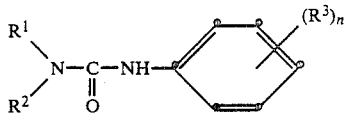

wherein;

$R^1$ is an alkyl or an aryl group;

$R^2$ is hydrogen or an alkyl group;

$R^3$ is an alkyl or an alkoxy group or an electron-withdrawing group with the proviso that $R^3$ is not a 5-mercaptotetrazole group; and n is from 0 to 3.

2. A photographic recording material according to claim 1 wherein the $R^3$ electron-withdrawing group is —CN, $—NO_2$, a halogen atom

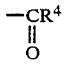

or $—SO_2R^4$, wherein $R^4$ is an alkyl or an alkoxy group having from 1 to about 20 carbon atoms or an aryl or an aryloxy group having from about 6 to about 12 carbon atoms.

3. A photographic recording material according to claim 2 wherein $R^3$ is chloro.

4. A photographic recording material according to claim 2 wherein $R^4$ is an alkyl group having from 1 to about 12 carbon atoms.

5. A photographic recording material according to claim 1 wherein $R^1$ is an alkyl group having from 1 to about 20 carbon atoms or an aryl group having from about 6 to about 12 carbon atoms.

6. A photographic recording material according to claim 1 wherein $R^2$ is an alkyl group having from 1 to about 20 carbon atoms.

7. A photographic recording material according to claim 1 wherein $R^1$ is an alkyl group having from about 4 to about 10 carbon atoms and $R^2$ is hydrogen.

8. A photographic recording material according to claim 1 wherein the magenta dye image-forming coupler is a pyrazolone compound.

9. A photographic recording material according to claim 1 wherein the magenta dye image-forming coupler is a pyrazolotriazole compound.

10. A photographic recording material according to claim 1 wherein the urea compound is present in an amount of from about 0.05 to about 5 parts by weight of coupler compound.

11. A photographic recording material according to claim 10 wherein the urea compound is present in an amount of from about 0.3 to about 3 parts by weight of coupler compound.

12. A photographic recording material according to claim 1 wherein the urea compound has the structural formula:

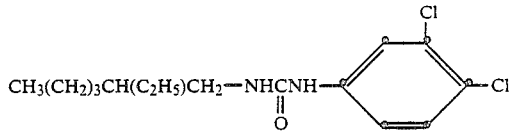

13. A photographic recording material according to claim 1 wherein the urea compound has the structural formula:

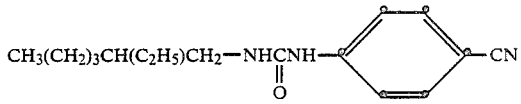

14. A photographic recording material according to claim 1 wherein the urea compound has the structural formula:

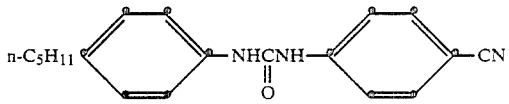

15. A photographic recording material according to claim 1 wherein the urea compound has the structural formula:

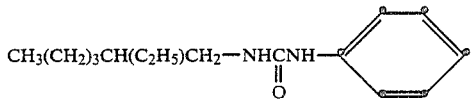

16. A color photographic record comprising a magenta dye formed by a coupling reaction between a magenta dye image-forming coupler and oxidized silver halide developing agent, which recording material comprises, in association with the dye, a urea compound having the structural formula:

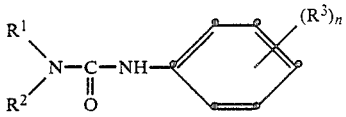

wherein;

$R^1$ is an alkyl or an aryl group;

$R^2$ is hydrogen or an alkyl group;

$R^3$ is an alkyl or an alkoxy group or an electron-withdrawing group with the proviso that $R^3$ is not a 5-mercaptotetrazole group; and n is from 0 to 3.

17. A photographic record according to claim 16 wherein the dye is formed from a pyrazolone magenta coupler compound.

18. A photographic record according to claim 16 wherein the dye is formed from a pyrazolotriazole magenta coupler compound.

19. A photographic record according to claim 16 wherein the dye is formed from a pyrazolobenzimidazole magenta coupler compound.

20. A photographic record according to claim 16 wherein the dye is formed from a indazole magenta coupler compound.

* * * * *